US006175972B1

(12) United States Patent
Wales

(10) Patent No.: US 6,175,972 B1
(45) **Date of Patent: *Jan. 23, 2001**

(54) KIT FOR INSTALLING BATH SPOUTS

(75) Inventor: Michael Wales, Riverside, CT (US)

(73) Assignee: Resources Conservation, Inc., Stamford, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/038,664

(22) Filed: Mar. 11, 1998

Related U.S. Application Data

(63) Continuation-in-part of application No. 08/902,641, filed on Jul. 30, 1997, now abandoned.

(51) Int. Cl.[7] ..... E03C 1/04
(52) U.S. Cl. ..... 4/678
(58) Field of Search ..... 4/675, 678; 137/359, 137/467, 801; 285/12

(56) References Cited

U.S. PATENT DOCUMENTS 1,724,131 * 8/1929 Gavaza ..... 137/801
3,136,570 * 6/1964 Lee ..... 4/678 X (List continued on next page.)

OTHER PUBLICATIONS

LDR Industries 1989 Catalog, p. A2.
LDR Sep. 1, 1990 Price List, pp. B2 and B3.
LDR 1997 Catalog, p. C2.
Chicago Specialty Jan. 3, 1995 Price List, pp. D2, D3 and D4.
Price Pfister Parts Catalog, distributed as early as Jul., 1971, p. E2.
Hancock–Gross/Plumbing Specialties 1977 Catalog, pp. F2, F3.
Sexauer Tub & Shower Repairs Catalog Section 6 (1995) pp. G2, G3, and G4.
TBA, Inc. 1996 Apr.–Jun. Specials Prie List, p. H2.
Plumb Park Product Catalog No. 89–8, published Aug. 1989, p. 12.
PlumbShop Catalog, published at least as early as Sep., 1995, pp. J2 and J3.
Laloo International, Inc.–EZ–FLO Jan., 1994 Catalog, p. K2.
Jones Stephens Corp. Price List, understood to be published at least as early as 1994, pp. L2 and L3.
Danco Catalog, understood to be published at least as early as 1994, p. M2.

(List continued on next page.)

*Primary Examiner*—Charles E. Phillips
(74) *Attorney, Agent, or Firm*—St. Onge Steward Johnston & Reens LLC

(57) ABSTRACT

A kit for installing a bath spout onto any one of a number of different pipe ends extending from a wall is described and includes a number of adapters sized to enable different pipe ends to be coupled into a standard screw thread of internal conduit inside the bath spout. One adapter enables the screw thread of a pipe end to be effectively enlarged. Another adapter slips onto the smooth outer surface of a pipe and makes a sealing contact with this surface while having one end provided with an enlarged external screw thread to mesh with a corresponding screw thread of a conduit inside the bath spout. An inner conduit is described which in one embodiment is made of a number of inter-connectable segments with which the length of the inner conduit can be adjusted and in another embodiment the inner conduit is formed of a single unitary structure with a several screw threads at a distal end to be able to adjust the length of the inner conduit with the removal of the distal thread.

10 Claims, 3 Drawing Sheets

U.S. PATENT DOCUMENTS

| | | | | |
|---|---|---|---|---|
| 3,913,605 | * | 10/1975 | Ward | 4/615 X |
| 4,171,005 | * | 10/1979 | Nickles | 137/469 |
| 5,291,969 | * | 3/1994 | Diederich | 285/12 X |

OTHER PUBLICATIONS

Jameco Industries Catalog, published Sep. 1, 1992 p. N2.
Matco–Norca 1996 Catalog & Price List, p. O2.
Zin Plas Corporation Price List, Jul., 1991, pp. P2–P5, P6.
Barnett Jul., Aug., Sep. 1994 Catalog, pp. Q2 and Q3.

* cited by examiner

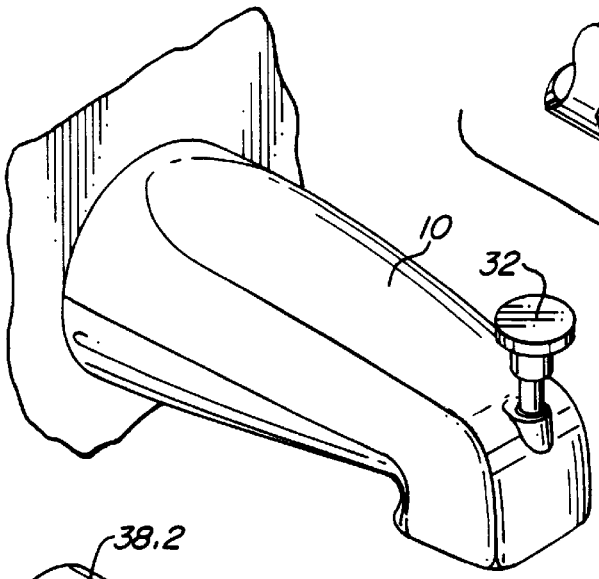
FIG. 1
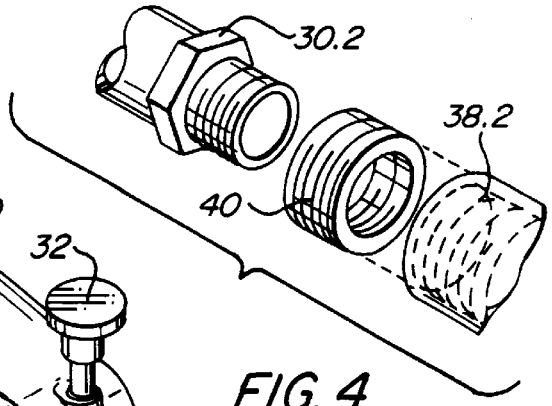
FIG. 4
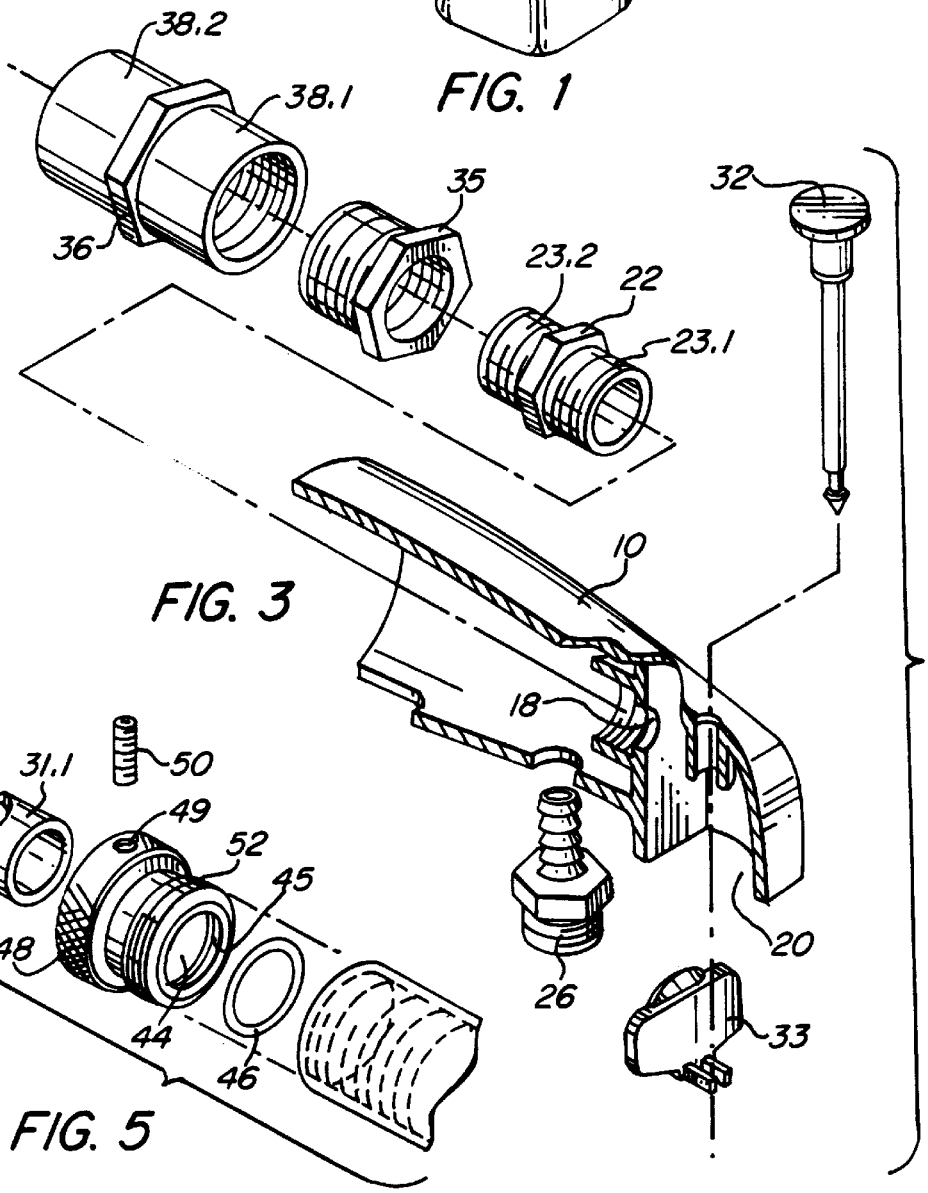
FIG. 3
FIG. 5

KIT FOR INSTALLING BATH SPOUTS

PRIOR APPLICATION

This application is a continuation-in-part of U.S. patent application Ser. No. 08/902,641 filed Jul. 30, 1997, now abandoned, by Michael Wales and entitled Kit For Installing Bath Spouts and assigned to the same assignee as for this invention.

FIELD OF THE INVENTION

This invention generally relates to bath spouts and more particularly to a kit for enabling a bath spout to fit with a wide variety of pipe connections.

BACKGROUND OF THE INVENTION

Bath spouts typically have a shell surrounding a central conduit through which water flows for use in the bath. The conduit requires a fitting to connect to a feed pipe extending from a wall adjoining the bath. This feed pipe, also known as a nipple, may have typical dimensions and end finishes such as a ¾ pipe with a ¾ or ½ threaded end, a ½ inch pipe with a threaded or smooth pipe end.

There are devices with which a bath spout's inner conduit can be mounted to ¾ or ½ inch threaded pipes. A need exists whereby a single kit can provide an installer with the connection capabilities suitable for most typical wall pipe ends.

SUMMARY OF THE INVENTION

In one universal and adjustable bath spout kit in accordance with the invention a spout shell is provided with a wholly or partially replaceable inner conduit to which one of several different adapters can be affixed to couple the inner conduit to a pipe nipple extending from the wall. The kit includes a metal or plastic spout shell having an internal end wall with a discharge port therein through which water is passed to a typically downwardly directed spout opening. An internally threaded coupling is positioned inside the spout shell over the discharge port and serves to enable an installer to insert the inner conduit. The inner conduit can be formed of a plurality of connectable plastic fittings that are screwed together to control the length of the inner conduit.

Alternatively the inner conduit can be made of a unitary plastic part. This part has a proximal or wall end where an adapter for attachment to the pipe nipple can be threaded. At a distil end the unitary inner conduit is provided with first and second external spaced apart screw threads each of which mesh with the threaded coupling inside the spout shell. Hence, when the inner conduit needs to be shortened, because a particular adapter is axially too large to enable a substantially flush fit of the spout shell with the wall, the distal screw thread on the inner conduit can be removed by cutting it off to shorten the inner conduit while leaving the second thread for attachment to the internal coupling.

When the inner conduit is formed of a single unitary part its cost can be significantly reduced and the various adapters necessary to accommodate the bath spout kit to various wall nipples as may be encountered in the field can be used while enabling a flush fit of the spout shell against the wall from which the pipe nipple extends.

As described herein for one embodiment in accordance with the invention the bath spout kit includes an inner conduit formed of a plurality of interfitting threaded segments with which the length of the inner conduit can be adjusted. This length adjustment is needed to enable the installer to assure a sealed connection with the pipe extending from the wall while having the enclosing spout shell fit essentially flush with the wall from which the pipe extends.

It is, therefore, an object of the invention to provide a universal bath spout kit with which an installer can adapt the spout to anyone of a variety of pipe ends.

It is a further object of the invention to provide a universal spout kit with adjustable features to facilitate the installation of a bath spout.

These and other objects and advantages of the invention can be understood from the following description of a preferred embodiment as shown in the drawings.

BRIEF DESCRIPTION OF THE DRAWINGS

FIG. 1 is a perspective view of bath spout mounted using a kit n accordance with the invention;

FIG. 3 is an exploded perspective view of various adapter attachments for coupling a bath spout to a wall pipe.

FIG. 4 is an exploded perspective view of one mounting of a bath spout using the kit of this invention;

FIG. 5 is an exploded perspective view of another mounting of a bath spout using the kit of this invention;

FIG. 11 is a side partial sectional view in elevation of another bath spout in accordance with the invention and of the type shown in FIGS. 7–10.

DETAILED DESCRIPTION OF DRAWINGS

Figure 2:
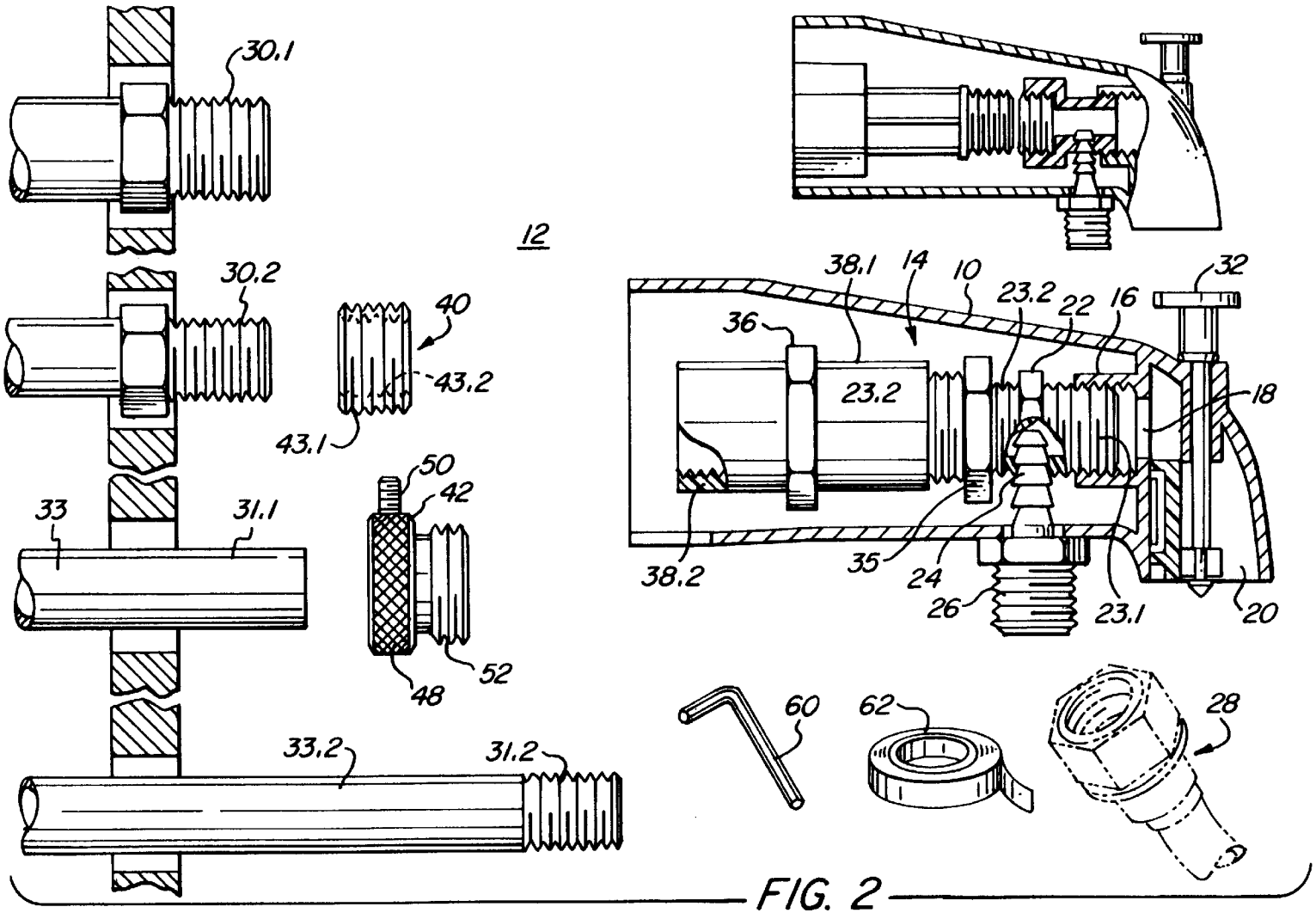
FIG. 2 is a side and partial section view in elevation of parts used in one kit for a bath spout in accordance with the invention.
Figure 6:
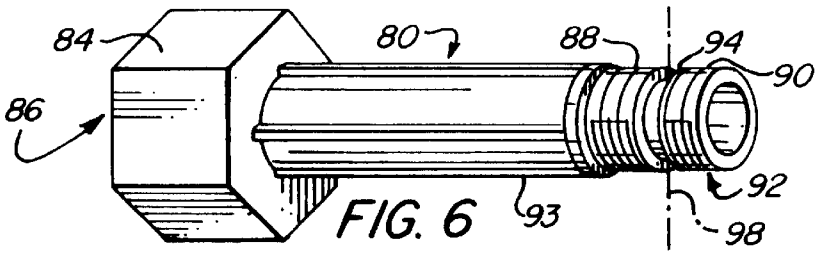
FIG. 6 is a perspective view of an inner conduit in accordance with the invention for use in installing a bath spout.
Figure 7:
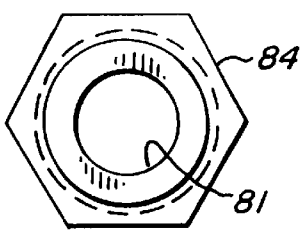
FIG. 7 is an end view of a proximal end of the inner conduit of FIG. 6.
Figure 8:
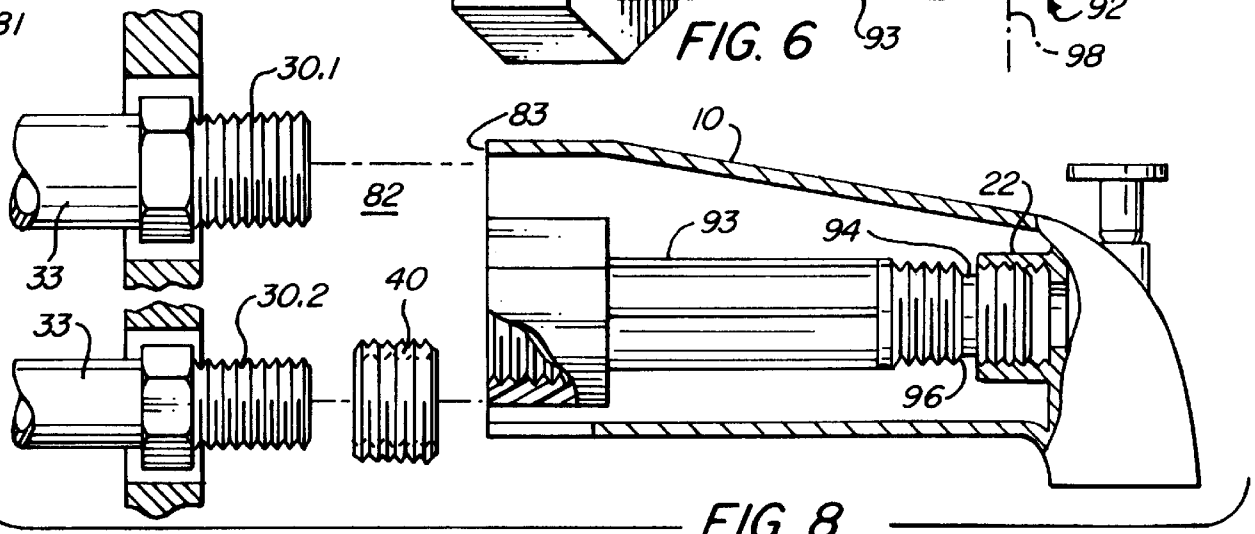
FIG. 8 is a side sectional view of an installed bath spout using the inner conduit of FIG. 6.

With reference to FIGS. 1–6 a bath spout shell 10 is shown for use in a kit 12 in accordance with the invention. The bath spout shell 10 can have many different shapes as are well known in the art and the particular shell 10 is shown for illustrative purposes. The shell 10, is shown with an internal conduit generally indicated at 14 and which is installed starting at an internally threaded metal bushing coupling 16 at a discharge port 18 leading to the discharge opening 20 of the spout shell 10.

A nylon or other plastic externally threaded male to male fitting 22 engages the internally threaded bushing 16 with an externally threaded segment 23.1 and has another externally threaded segment 23.2. The fitting 22 is provided with an opening 24 for a shower connector 26. A flexible shower hose 28, as illustrated in phantom at 28, can be coupled to connector 26. This shower connector 26 need not always be a part of the shell 10 since shower installations are typically already a part of the plumbing coupled to a wall nipple 30 to which the bath spout is to be connected. The same optional feature applies to the use of the manual water deflector 32 and connected seal 33 located on the end of the spout shell 10.

The internal conduit 14 extends towards the front or proximal end of the shell 10. The conduit 14 includes an intermediate coupling 35 and an end coupling 36 having female internally threaded segments 38.1 and 38.2 one of which is sized to mesh with and fit over threaded male segment 23.2 of the fitting 22. These various inter-meshing couplings 22, 35, 36 are interconnected in such manner as to adjust the overall axial length of the inner conduit 14. This length is adjusted to accommodate the various different lengths of adapters that are used at the proximal or wall end of the inner conduit for attachment to the wall pipe 33.

In the kit 12, the internal threaded portion of bushing 16 has a ½ inch diameter, the male segments 23.1 and 23.2 have a ¾ inch diameter and the female end coupling 36 has a corresponding meshing size for its female threaded segments 38. The kit 12 is made to fit with different wall pipe nipples 30, such as a ¾ inch externally threaded nipple 30.1, a ½ inch threaded nipple 30.2, a straight pipe end 31.1 and a ½ inch extended threaded pipe end 31.2. In order to be able to adapt the bath spout 10 to anyone of the nipples 30 and to pipes 33 having pipe ends 31, adapters 40 and 42 are provided.

Adapter 40 is a diameter reducer as viewed from the % size of the threaded female segment 38.2. Adapter 40 has a ¾ external thread 43.1 and has a ½ inch internal thread 43.2. Hence, adapter 40 can fit around nipple 30.2 and inside thread 38.2 to enable the bath spout to be coupled thereto.

A slip fit adapter 42 is provided with a smooth internal bore 44 sized to smoothly fit over the smooth ½ inch pipe end 31.1. Bore 44 has a groove 45 sized to receive an O ring 46 sized to sealingly contact the external surface of the smooth ½ inch pipe end 31.1. The slip fit adapter 42 has, at one end, a flange 48 with at least one threaded hole to receive a set screw 50 with which the flange can be affixed in place on pipe end 31.1. At the other end of the flange is a ¾ external thread 52 to mesh with that inside the female segment 38,2 inside the spout shell 10. Adapter 42 can also be used to couple the pipe 33.2 with the threaded pipe end 31.2. This typically involves a cutting of the pipe 33.2 to the desired length, such as pipe end 31.1, and then attaching the slip fit adapter 42. Alternatively, the pipe 33.2 can be directly affixed to fitting 16 after first removing the conduit 14. Such removal is readily accomplished after first removal of the side coupler 26 when it is used, and then unscrewing the conduit 14 from fitting 16.

Kit 12 may include accessory articles such as an alien wrench 60 for set screw 50 and a roll of suitable sealing tape 62.

With reference to FIGS. 6–10 an alternate design for an inner hollow conduit 80 for use with a bath spout kit 82 is shown with a through bore 81. The inner conduit 80 is formed of a unitary elongate plastic part with a ¾ inch thread receptacle 84, similar to segment 38.2 shown in FIG. 2, at a proximal end 86 and a pair of external axially spaced apart threads 88, 90 at a distal end 92 of a cylindrical shank 93. The threads 88, 90 are identical and mesh with the thread inside the coupling 22 inside the bath spout shell 10 or an extension thereof. The extension can be provided by the segment 22 in FIG. 1 to enable a shower adapter to be connected as described. The threads 88, 90 are separated by a short smaller diameter portion 94, which is just sufficiently axially wide to enable one to sever the inner conduit 80 at portion 94 and leave the remaining thread 88 in tact with its starting thread 96.

Figure 9:
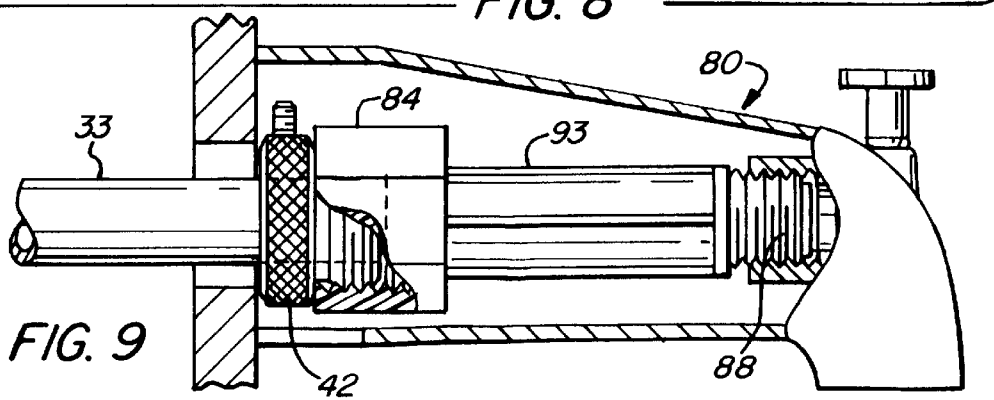
FIG. 9 is another side sectional view of an installed bath spout using the inner conduit of this invention and with a different adapter from the one shown in the view of FIG. 8.
Figure 10:
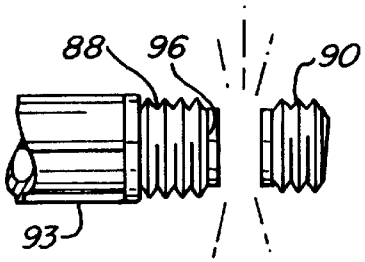
FIG. 10 is a partial side view in elevation of the distal end of the inner conduit shown in FIG. 6 during a shortening thereof to accommodate an axially long pipe adapter.

The axial length of the distal thread 90 is selected so that when an axially long adapter, such as the slip adapter 42, is applied to the proximal end 86 as illustrated in FIG. 9, the inner conduit 80 normally would be too long and the slip adapter would stick out of the wall end 83 of the bath spout 10. Accordingly, the installer would cut the inner conduit 80 along a radial plane represented by line 98 and as a result sever the distal threaded portion 90 from the inner conduit as shown in FIG. 10. Since the remaining thread 88 is identical to thread 90, the thread 88 can serve to connect the inner conduit 80 to internal coupling 22 or an extension thereof and the now shortened conduit would enable the slip fit adapter 42 to fit inside the bath spout 10 as illustrated in FIG. 9.

With an inner conduit 80 the multiple couplings 22 35 and 36 for the embodiment shown in FIGS. 7–10 can be combined into a single structure, thus reducing costs, simplifying the kit 82 and the installation of the bath spout 10.

In case where a shower adapter coupling 26, as shown in FIG. 3, is used, the inner conduit 80' as illustrated in FIG. 11 has its shank 93' shortened to accommodate a coupling 100 for connection to a shower connector 26. The coupling 100 in effect provides an extension of the inner threaded bushing 16 and has an opening to receive a shower connector 26 through an opening 17 in bath spout shell 10. The coupling 100 thus has a threaded end 102 that meshes with the thread inside bushing 16 and has a threaded counterbore 104 to receive the threads 88, 90 of inner conduit 80'.

Having thus explained a novel kit for affixing a bath spout to wall pipes of different sizes, various changes can be considered by one skilled in the art without departing from the scope of the invention. For example, the wall pipes can have different sizes as described herein and thus the corresponding thread sizes also changed. The invention is described for use with a bath spout, though it is to be understood that other water faucets can be accommodated and that the term bath spout as used herein, therefore, includes all such otter water faucets.

What is claimed is:

1. A universal and adjustable bath spout kit formed of a collection of materials within a container for installing a bath spout to a wall pipe extending from a wall, comprising:

a bath spout shell having a discharge opening and an internal coupling coupled thereto for supplying water to the discharge opening; an inner conduit for effectively extending the internal coupling towards a wall end of the bath spout shell, said inner conduit having a wall end and a discharge end and further having a female threaded segment facing the wall end, said female threaded segment having a size selected to accommodate and mesh with a first type of thread as may occur on the wall pipe;

a first adapter having a through bore with an internal thread sized to receive and mesh with a second type of thread on the wall pipe end and having an external thread sized to mesh with the female threaded segment at the wall end of the inner conduit;

a slip fit adapter having a smooth through bore sized to receive and fit over a wall pipe having a smooth outer surface, and sealing means inside said through bore to sealingly engage said smooth outer surface, said slip fit adapter having an externally threaded end sized to mesh with said female threaded segment of the inner conduit;

said inner conduit having a length which is adjustable between its discharge and wall ends so that, when either said first adapter or said slip fit adapter is affixed to said inner conduit, the wall end of the spout shell can accommodate a substantially flush mounting of said wall end of the bath spout shell with the wall from which said wall pipe extends.

2. The universal and adjustable bath spout kit as claimed in claim 1 wherein said inner conduit comprises a plurality of threaded segments which inter-mesh with each other, with one of said latter segments having said female threaded segment.

3. The universal and adjustable bath spout kit as claimed in claim 1 wherein said inner conduit comprises a unitary part having a proximal end provided with said female threaded segment and having a discharge end, said discharge end having first and second axially spaced apart threads each being like sized to mesh with a threaded opening, said unitary part being severable between said axially spaced apart threads to adjust the length of said inner conduit for installing said bath spout shell onto said wall pipe.

4. The universal and adjustable bath spout kit as claimed in claim 1 and further including a tool for applying the affixing means and a roll of thread sealing tape.

5. A fitting for use in the installation of a bath spout to a wall pipe extending from a wall wherein the bath spout includes a bath spout shell having a wall end and a discharge opening and a threaded internal coupling coupled to the discharge opening for supplying water thereto, comprising:

an inner conduit for effectively extending the internal coupling towards a wall end of the bath spout shell, said inner conduit having a wall end and a discharge end, said inner conduit having near its discharge end first and second like sized threaded segments sized to mesh with the threaded internal coupling, with said inner conduit being severable at a point that is between the first and second threaded segments so that the remaining externally threaded segment, after the threaded segment near the discharge end has been severed from the inner conduit, can mesh with the threaded internal coupling or an extension thereof for an adjustment of the length of the inner conduit so that, when the bath spout shell is affixed to said wall pipe, the wall end of said inner conduit can accommodate a substantially flush fit of said wall end of the bath spout shell with the wall from which the wall pipe extends.

6. The fitting as claimed in claim 5 wherein said inner conduit has a threaded female end at its wall end sized so as to be able to directly mesh with a threaded segment of said wall pipe.

7. The fitting as claimed in claim 6 wherein said first and second threaded segments on said conduit are axially spaced apart from each other.

8. A universal and adjustable bath spout kit formed of a collection of materials in a container for installing a bath spout to a wall pipe extending from a wall, comprising:

a bath spout shell having a discharge opening and an internally threaded coupling coupled thereto for supplying water to the discharge opening;

an inner conduit for effectively extending the internal coupling towards a wall end of the bath spout shell, said inner conduit having a wall end and a discharge end and further having a first threaded segment for facing the wall end, said first threaded segment having a size selected to accommodate and mesh with a first type of thread as may occur on the wall pipe;

wherein said inner conduit comprises a unitary part having a proximal end provided with said first threaded segment and having a discharge end, said discharge end having first and second axially spaced apart threads each sized to mesh with the internally threaded coupling, said unitary part being severable between said axially spaced apart threads to adjust the length of said inner conduit for installing said bath spout shell onto said wall pipe;

a first adapter having a through bore with a first thread sized to receive and mesh with a second type of thread on the wall pipe end and having a second thread sized to enable it to be effectively coupled to the first threaded segment of the inner conduit;

a slip fit adapter having a smooth through bore at one end thereof and being sized to receive and fit over a wall pipe having a smooth outer surface, and sealing means inside said through bore to sealingly engage said smooth outer surface, said slip fit adapter having a threaded end, at an opposite end to said one end, to enable said slip fit adapter to be coupled to said inner conduit;

said inner conduit having a length which is adjustable so that, when either said first adapter or said slip fit adapter is coupled to said inner conduit, the wall end of the spout shell can accommodate a substantially flush mounting of said wall end of the bath spout shell with the wall from which said wall pipe extends.

9. A fitting for use in the installation of a bath spout to a wall pipe extending from a wall wherein the bath spout includes a bath spout shell having a wall end and a discharge opening and a threaded internal coupling coupled to the discharge opening for supplying water thereto, comprising:

an inner conduit for effectively extending the internal coupling towards a wall end of the bath spout shell, said inner conduit having a wall end having a first screw thread and a discharge end having a second screw thread, said first screw thread having a size selected to accommodate and mesh with a first type of screw thread as may be effectively placed on the wall pipe; said second screw thread being selected to mesh with the threaded internal coupling or an extension thereof; said inner conduit further having a length which is adjustable between the first and second screw threads so that, when the bath spout shell is affixed to said wall pipe, the wall end of said inner conduit can accommodate a substantially flush fit of said wall end of the bath spout shell with the wall from which the wall pipe extends.

10. A fitting for use in the installation of a bath spout to a wall pipe extending from a wall wherein the bath spout includes a bath spout shell having a wall end and a discharge opening and a threaded internal coupling coupled to the discharge opening for supplying water thereto, comprising:

an inner conduit for effectively extending the internal coupling towards a wall end of the bath spout shell, said inner conduit having a wall end having a first screw thread and a discharge end, said first screw thread having a size selected to accommodate and mesh with a first type of screw thread as may be effectively placed on the wall pipe;

wherein said inner conduit is formed of a unitary structure having first and second spaced apart like sized externally threaded segments at said discharge end, with said inner conduit being severable at a point that is between the first and second spaced apart threaded segments so that the remaining externally threaded segment, after the externally threaded segment near the discharge end has been severed from the inner conduit, can mesh with the threaded internal coupling or an extension thereof for an adjustment of the length of the inner conduit and so that, when the bath spout shell is affixed to said wall pipe, the wall end of said inner conduit can accommodate a substantially flush fit of said wall end of the bath spout shell with the wall from which the wall pipe extends.

* * * * *